US008233819B2

(12) United States Patent
Kondo

(10) Patent No.: US 8,233,819 B2
(45) Date of Patent: Jul. 31, 2012

(54) IMAGE-FORMING DEVICE HAVING DETACHABLE PROCESS CARTRIDGE

(75) Inventor: Hakudai Kondo, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 477 days.

(21) Appl. No.: 12/487,034

(22) Filed: Jun. 18, 2009

(65) Prior Publication Data

US 2010/0074648 A1 Mar. 25, 2010

(30) Foreign Application Priority Data

Sep. 22, 2008 (JP) ..... 2008-243104

(51) Int. Cl.
*G03G 21/16* (2006.01)

(52) U.S. Cl. ..... 399/111

(58) Field of Classification Search ..... 399/107, 399/110–114
See application file for complete search history.

(56) References Cited

U.S. PATENT DOCUMENTS

| | | | | |
|---|---|---|---|---|
| 5,485,244 | A | 1/1996 | Gotoda et al. | |
| 5,486,898 | A | 1/1996 | Fujii et al. | |
| 6,330,410 | B1 | 12/2001 | Okabe et al. | |
| 6,473,576 | B1 | 10/2002 | Koshimizu et al. | |
| 6,941,094 | B2 * | 9/2005 | Omata et al. | 399/121 |
| 7,384,033 | B2 | 6/2008 | Asada | |
| 7,496,315 | B2 | 2/2009 | Mase | |
| 2005/0194733 | A1 | 9/2005 | Asada | |
| 2005/0276630 | A1 | 12/2005 | Nishimura | |
| 2006/0220309 | A1 | 10/2006 | Igarashi | |
| 2007/0122187 | A1 | 5/2007 | Mase | |

FOREIGN PATENT DOCUMENTS

| | | |
|---|---|---|
| JP | H05-53378 | 3/1993 |
| JP | H06-051574 | 2/1994 |
| JP | H07-152302 | 6/1995 |
| JP | H10-312096 | 11/1998 |
| JP | 10-339982 | 12/1998 |
| JP | 2001-34144 | 2/2001 |
| JP | 2001-53919 | 2/2001 |
| JP | 2001-75457 | 3/2001 |
| JP | 2001-209220 | 8/2001 |
| JP | 2002-311723 | 10/2002 |
| JP | 2003-11412 | 1/2003 |
| JP | 2003-15500 | 1/2003 |
| JP | 2003-246480 | 9/2003 |

(Continued)

*Primary Examiner* — Hoan Tran
(74) *Attorney, Agent, or Firm* — Scully, Scott, Murphy & Presser, PC

(57) ABSTRACT

An image forming device capable of attaching and detaching a process cartridge to and from a frame without mechanical interference of the process cartridge with sheet feed unit and an LED array and without any movement of the LED array. 1. The image forming device includes the process cartridge detachably assembled in a frame and accessible through a front opening upon opening a door. The cartridge includes a casing movably supported by the frame, a photosensitive drum, a charger, and a developing roller. A sheet cassette is detachably installed to the frame at a position below the process cartridge for accommodating a stack of sheets. A sheet feed unit is supported to the process cartridge. The LED array is supported to the frame and is provided independent of the casing. A guide structure is provided at tire frame to guide movement of the process cartridge along with the sheet feed unit from an image forming operating position toward the door and away from the LED array.

12 Claims, 4 Drawing Sheets

FOREIGN PATENT DOCUMENTS

| | | |
|---|---|---|
| JP | 2005-247539 | 9/2005 |
| JP | 2005-352058 | 12/2005 |
| JP | 2006-256807 | 9/2006 |
| JP | 2006-301385 | 11/2006 |
| JP | 2007-155793 | 6/2007 |
| JP | 2007-286127 | 11/2007 |

* cited by examiner

IMAGE-FORMING DEVICE HAVING DETACHABLE PROCESS CARTRIDGE

CROSS REFERENCE TO RELATED APPLICATION

This application claims priority from Japanese Patent Application No. 2008-243104 filed Sep. 22, 2008. The entire content of the priority application is incorporated herein by reference.

TECHNICAL FIELD

The present invention relates to an image forming device and more particularly, to an electrophotographic type image forming device.

BACKGROUND

An electrophotographic type image forming device generally includes a photosensitive drum, a charge unit, an LED array, and a developing unit. The charge unit is adapted for uniformly charging a surface of the photosensitive drum. The LED array is adapted for forming an electrostatic latent image on the charged surface of the photosensitive drum. The developing unit is adapted for forming a visible developer agent image with charged developer agent at the electrostatic latent image. The visible image is then transferred onto an image recording medium such as a sheet fed from a sheet cassette, so that the visible image can be formed on the sheet.

In such a conventional image forming device, a process cartridge is detachably provided to a frame of the device. The process cartridge accommodates therein the photosensitive drum, the charge unit, and the developing unit. The process cartridge can be exchanged with a new process cartridge upon consumption of developer agent or upon degradation of the photosensitive drum. In order to perform such exchange, one of the photosensitive drum, the charge unit and the developing unit may be mechanically interfered with the LED array. Such interference may occur easily in a front access type image forming device in which the frame has a front side provided with a cover, and the process cartridge can be detached from the frame through a front opening after opening the cover.

In order to avoid such mechanical interference, a link mechanism has been proposed that retracts an LED array to a non-interference position with respect to the process cartridge when a door is open. This structure can facilitate removal of the process cartridge from the frame.

However, operating position of the LED array may be varied in accordance with a repeated retracting movement thereof, which degrades imaging quality. Instead of moving the LED array, the latent image is maintained stationary whereas the process cartridge is moved for its detachment and attachment away from the LED array. However, in the latter case, a sheet feed mechanism and the sheet cassette may become an obstacle for the moving the process cartridge away from the LED array.

That is, the sheet cassette and the sheet feed mechanism for feeding the sheet from the sheet cassette are generally disposed at a lower portion of the frame and below the process cartridge. On the other hand, the LED array is disposed at an upper portion of the frame and above the process cartridge. Therefore, the process cartridge may be mechanically interfered with the sheet feed mechanism and the sheet cassette by the movement of the process cartridge in a direction away from the LED array.

SUMMARY

It is therefore an object of the present invention to provide an image forming device facilitating detachment of the process cartridge avoiding mechanical interference of the process cartridge with the LED array without any movement of the LED array and without any mechanical interference with the sheet feed mechanism and the sheet cassette when the door is open.

This and other objects of the invention will be attained by providing an image forming device including a frame, a process cartridge, a sheet cassette, a sheet feed unit, an LED array, and a guide structure. The frame has a front opening provided with a door. The process cartridge is detachably assembled in the frame and is accessible through the front opening upon opening the door. The process cartridge is movable to an operating position in the frame for image formation. The process cartridge includes a casing, a photosensitive drum, a charger and a developing roller. The casing is movably supported by the frame. The photosensitive drum is disposed in the casing and has an outer surface in which an electrostatic latent image is formable. The charger is disposed in the casing for uniformly charging the photosensitive drum. The developing roller is disposed in the casing for supplying charged developer agent to the photosensitive drum. The sheet cassette is detachably installed to the fame at a position below the process cartridge for accommodating a stack of sheets. The sheet feed unit is supported to the process cartridge for feeding each one of sheets on the sheet cassette toward the photosensitive drum. The LED array is supported to the frame and is provided independent of the casing for forming an electrostatic latent image on the photosensitive drum after the photosensitive drum is charged by the charger. The process cartridge and the sheet feed unit are positioned between the LED array and the sheet cassette at the operating position, and the photosensitive drum is positioned close to the LED array at the operating position. The guide structure is provided at the frame to guide movement of the process cartridge along with the sheet feed unit from the operating position toward the door and away from the LED array.

DETAILED DESCRIPTION

Figure 1:
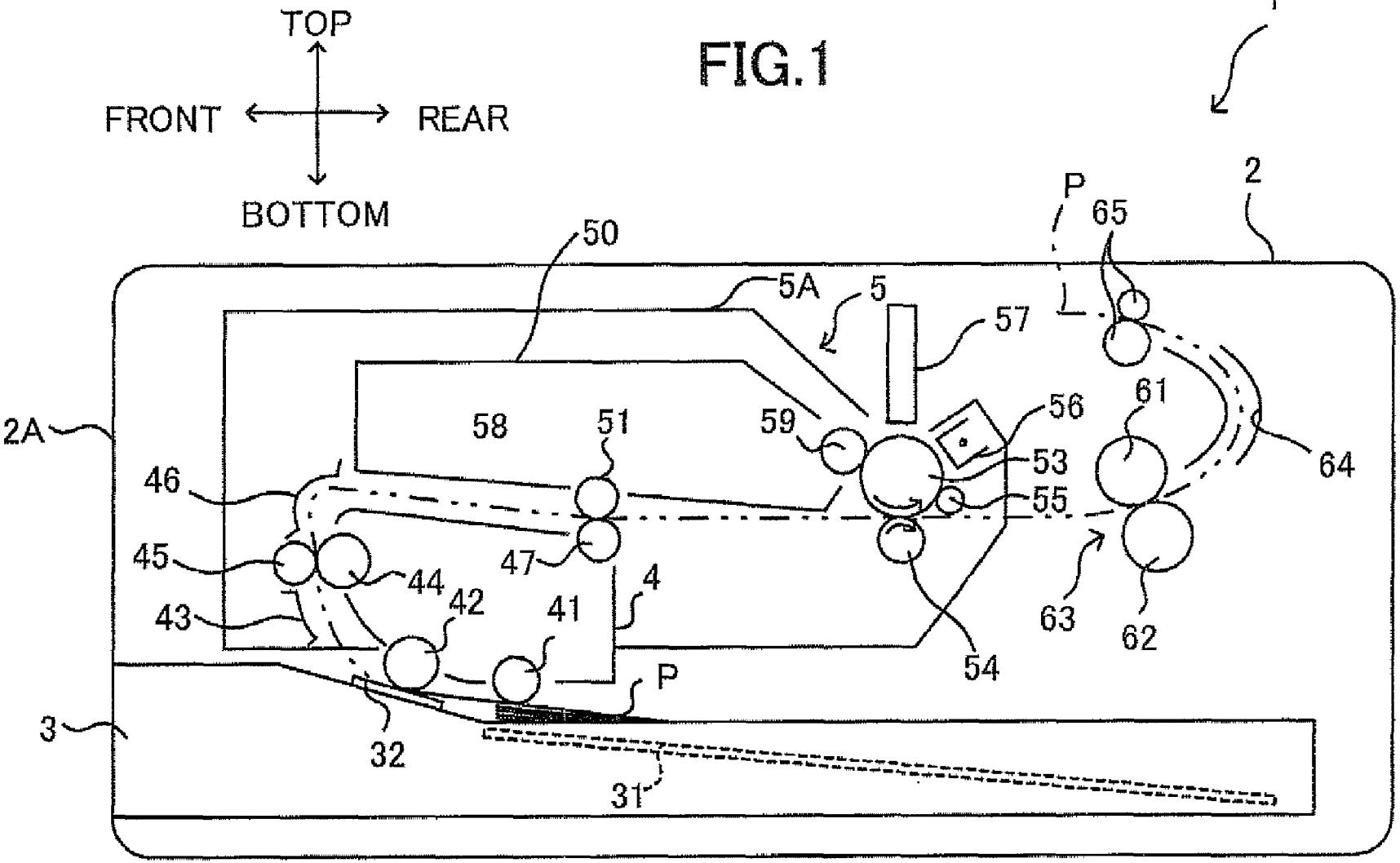
FIG. 1 is a schematic vertical cross-sectional view of an image forming device according to a first embodiment of the present invention.

An image forming device according to a first embodiment of the present invention will be described with reference to FIGS. 1 through 3. The first embodiment pertains to a monochromatic laser printer. The terms "upward", "downward", "upper", "lower", "above", "below", "beneath", "right", "left", "front", "rear" and the like will be used throughout the description assuming that the image forming device is disposed in an orientation in which it is intended to be used.

The image forming device 1 includes a frame 2 having a front opening provided with a door 2A which can be opened and closed. The front side is a side toward which a sheet P formed with an image is ejected. The frame 2 has a lower portion at which a sheet cassette 3 is movable in frontward/rearward direction. In the sheet cassette 3, a plurality of cut sheets is stacked. A process cartridge 5 is detachably attached to the frame 2. The process cartridge 5 can be accessible through the front opening when the door is open for detachment and attachment of the process cartridge 5 with respect to the frame 2.

The process cartridge 5 integrally provides a sheet feed unit 4. More specifically, the process cartridge 5 includes a cartridge case 5A having a front lower portion to which the sheet feed unit 4 is fixed. Further, a developing cartridge 50 is detachably attached to the cartridge case 5A. The developing cartridge 50 and the sheet feed unit 4 define a sheet passage therebetween as shown by two dotted chain line in FIG. 1. The developing cartridge 50 can be referred to as one of the components of the process cartridge 5.

The sheet cassette 3 is detachably assembled to the lower portion of the frame 2, and includes a pressure plate 31 at a lower portion of a body of the cassette 3. The pressure plate 31 has a rear end pivotally connected to the body of the sheet cassette 3 so that a front end of the pressure plate 31 can be moved upward for lifting the sheet stack on the pressure plate 31. Further, a separation pad 32 made from an elastic material is provided at a front side of the body of the cassette 3. The separation pad 32 is urged upward by a spring (not shown)

The sheet feed unit 4 includes a sheet supply roller 41 and a separation roller 42. The sheet supply roller 41 is provided to contact an uppermost sheet P of the sheet stack in the sheet cassette 3. The separation roller 42 is positioned immediate downstream of the sheet supply roller in a sheet feeding direction and in confrontation with the separation pad 32. The uppermost sheet P supplied from the sheet supply roller 41 is nipped between the separation roller 42 and the separation pad 32 for separating the uppermost sheet P from the remaining sheet stack.

The sheet feed unit 4 also includes a feed roller 44, and a registration roller 47. The process cartridge 5 includes sheet guides 43 positioned immediate downstream of the separation roller 42, a feed roller 45 in direct confrontation with the sheet feed roller 44 and immediate downstream of the sheet guide 43, and a sheet guide 46 immediate downstream of the feed rollers 44, 45. The developing cartridge 50 includes a registration roller 51 in direct confrontation with the registration roller 47 and downstream of the sheet guide 46.

The sheet P moved past the separation roller 42 is fed to the feed rollers 44, 45 through the sheet guide 43. The sheet fed from the feed rollers 44, 45 is fed to the pair of registration rollers 47, 51 through the sheet guide 46 and the sheet passage defined between the sheet feed unit 4 and the developing cartridge 50, whereupon an orientation of a leading edge of the sheet P is corrected, and the sheet P provisionally stayed at the registration rollers 47, 51 is then fed into the process cartridge 5 at a prescribed timing.

The process cartridge 5 also includes a photosensitive drum 53, a transfer roller 54, a cleaner 55, a charger 56, and a developing roller 59. Further, an LED array 57 is provided adjacent the process cartridge 5, i.e., adjacent to the photosensitive drum 11.

The photosensitive drum 53 includes a drum body grounded, and a photosensitive layer formed thereover and made from a positively chargeable material such as polycarbonade. The drum body includes a rotation shaft 53A as shown in FIG. 2. The photosensitive drum 53 is rotatable in a counterclockwise direction in FIG. 1. The transfer roller 54 is rotatably provided to nip the sheet P in cooperation with the photosensitive drum 53 for transferring a toner image on the photosensitive drum 53 onto the sheet P.

The cleaner 55, the charger 56, the LED array 57, and the developing roller 59 are disposed around the photosensitive drum 53 in the order from the transfer roller 54 in the rotating direction of the photosensitive drum 53. The cleaner 55 is in the form of a roller in rolling contact with the photosensitive drum 53 for removing residual toner (developer agent) remaining on the surface of the photosensitive drum 53. The charger 56 is a positively charging scorotron type charger having a tungsten wire from which a corona discharge occurs so as to uniformly charge the surface of the photosensitive drum 53 with positive polarity.

The LED array 57 includes a plurality of light emitting elements arrayed in a lateral direction (widthwise direction of the sheet P) for exposing the outer peripheral surface of the photosensitive drum 53 to light in accordance with image data. As the light emitting element, a semiconductor diode and an electro-luminescence element are available. The LED array 57 is fixed to the frame 2 independent of the process cartridge 5 at a position immediately above the photosensitive drum 53 and above and rearward of the process cartridge 5. In other words, the process cartridge 5 is positioned between the sheet feed unit 4 and the LED array 57.

The developing roller 59 is provided in the developing cartridge 50 defining therein a toner container 58 in which positively chargable non-magnetic single component type toner is accommodated. The developing roller 59 is adapted for supplying such toner to the outer peripheral surface of the photosensitive drum 53 to form a positively charged thin toner layer thereover.

After the cleaner 55 removes residual toner on the photosensitive drum 53 during its rotation, the surface of the photosensitive drum 53 is uniformly positively charged by the charger 56. Then, the surface is exposed to light by the LED array 57, whereupon electrostatic latent image based on the image data is formed on the surface of the photosensitive drum 53. The latent image area has a potential lower than that of the remaining portion.

Then, positively charged toner is supplied to the photosensitive drum 53 from the developing roller 59. As a result, a visible toner image corresponding to the electrostatic latent image is formed on the surface of the photosensitive drum 53.

The transfer roller 54 is rotatable in a clockwise direction in FIG. 1. The transfer roller 54 includes a roller shaft made from metal and a rubber layer formed over the roller shaft. The rubber layer is made from ion conductive rubber material. A transfer bias is applied to the transfer roller 12 so as to transfer the toner image onto the sheet P passing through the photosensitive drum 53 and the transfer roller 54. A fixing unit 63 including a heat roller 61 and a pressure roller 62 are provided. The toner image on the sheet P is thermally fixed when the sheet passes through the heat roller 61 and the pressure roller 62. A curved sheet discharge path 64 extends from the fixing unit 63 so as to direct the sheet P frontward. A pair of discharge rollers 65 is provided at an exit of the discharge path 64 to discharge the sheet P onto a discharge tray (not shown).

Figure 2:
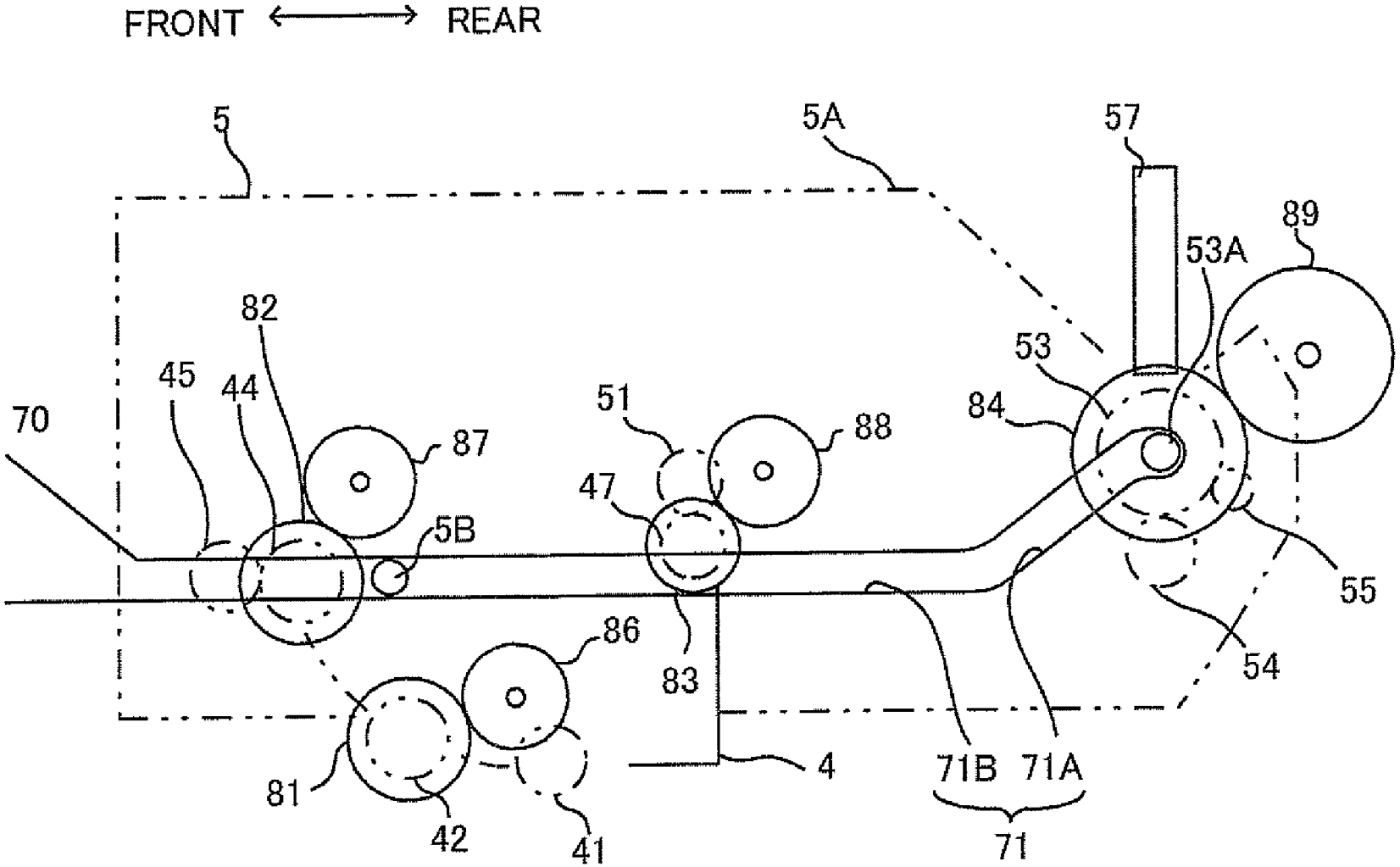
FIG. 2 is a schematic view of a process cartridge, a drive mechanism for driving the process cartridge and guide mechanism for guiding movement of the process cartridge in the image forming device according to the first embodiment.
Figure 3:
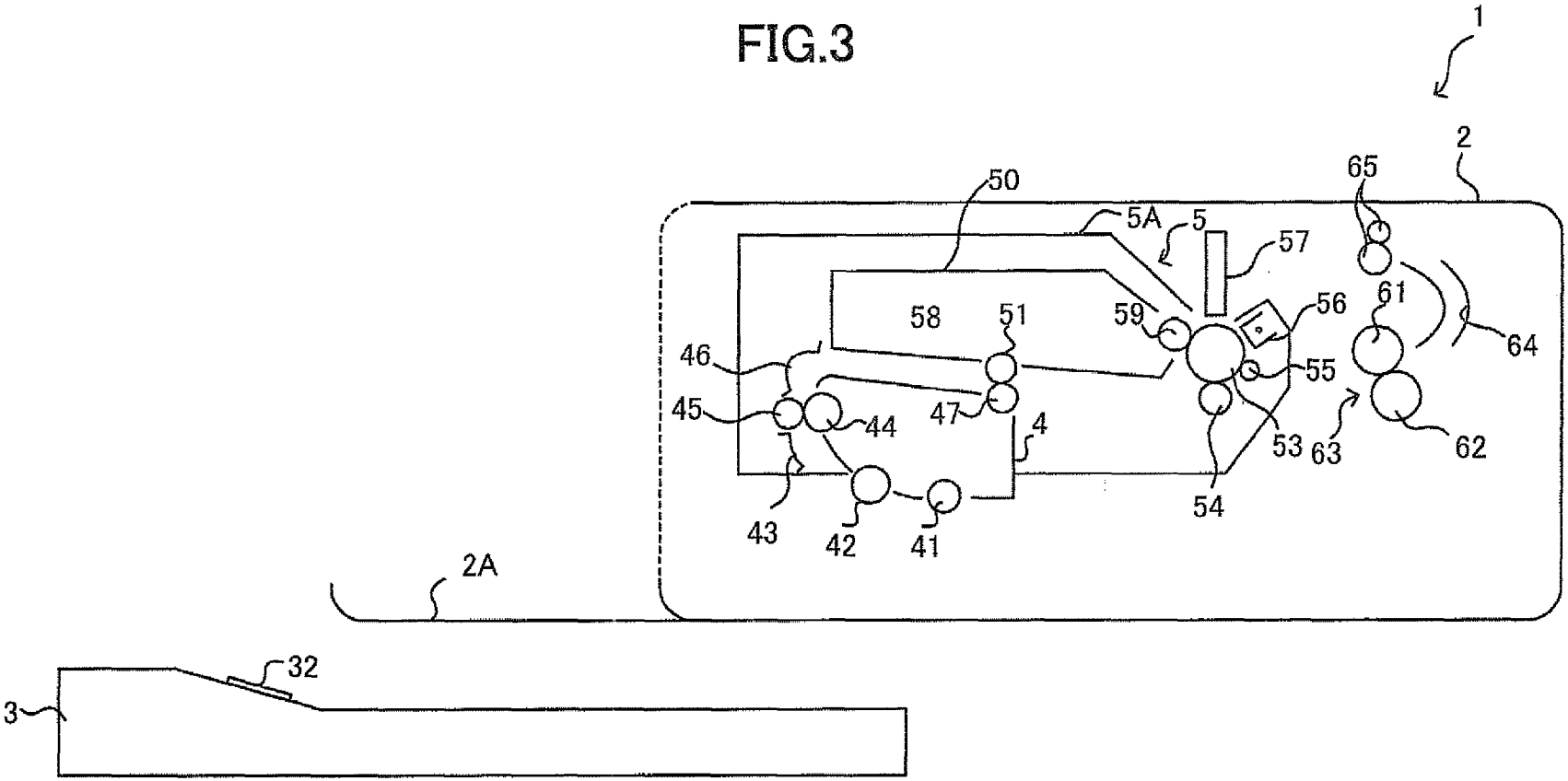
FIG. 3 is a schematic view of the process cartridge in its detaching or attaching state according to the first embodiment.

FIG. 2 shows a drive mechanism and a guide mechanism for the process cartridge 5 as viewed from a left side of the process cartridge 5. A pair of support frames 70 are provided inside the frame 2 for supporting the cartridge case 5A at laterally outer sides thereof. Each support frame 70 is formed with a guide groove 71 for guiding movement of the process cartridge 5 with respect to the support frame 70. The guide groove 71 includes a slanting groove 71A and a horizontal groove 71B. The slanting groove 71A is positioned rearward of the horizontal groove 71B and is inclined upward toward rearward. The horizontal groove 71B extends to a front end of the support frame 70 and is open at the front end.

The rotation shaft 53A of the photosensitive drum 53 protrudes laterally outward from the cartridge case 5A, so as to engage the guide groove 71. Further, the cartridge case 5A is provided with bosses 5B protruding from lateral sides thereof and positioned frontward of the rotation shaft 53A so as to engage the guide groove 71. The process cartridge 5 is thus movably supported to the support frame 70 by way of sliding engagement of the rotation shaft 53A and the bosses 5B with the guide grooves 71.

The photosensitive drum 53 can be subjected to positioning at a position immediately below the LED array 57 as a result of push-in movement of the process cartridge 5 until the rotation shaft 53A reaches a rearmost end of the guide groove 71, that is, the highest end of the slanting groove 71A. This position is an operable position of the process cartridge 5 for image formation. For detaching the process cartridge 5 from the frame 2, the rotation shaft 53A is slidingly moved along the slanting groove 71A downward so that the process cartridge 5 is gradually moved away from the LED array 57 as a result of pull-out movement of the process cartridge 5.

As shown in FIG. 2, driven gears 81 through 84 are provided at the left side of the cartridge case 5A. The gear 81 is coaxially coupled to the separation roller 42, the gear 82 is coaxially coupled to the feed roller 44, the gear 83 is coaxially coupled to the registration roller 47, and the gear 84 is coaxially coupled to the photosensitive drum 53. On the other hand, the frame 2 rotatably supports transmission gears 86, 87, 88 and 89 those drivingly rotated by a motor (not shown) and meshingly engaged with the driven gears 81, 82, 83, and 84, respectively. Therefore, in the state that the process cartridge 5 is at its operable position, the separation roller 42, the feed roller 44, the registration roller 47 and the photosensitive drum 53 are rotated concurrently upon actuation of the motor. Incidentally, the sheet supply roller 41 can be rotated intermittently by way of the rotation of the separation roller 42 through an idle gear (not shown).

In the laser printer according to the first embodiment the process cartridge 5 can be moved away from the LED array 57 in case of attachment and detachment of the process cartridge 5. Therefore, mechanical interference of the process cartridge 5 with the LED array 57 can be avoided without any movement of the LED array 57. Further, since the process cartridge 5 is integrally provided with the sheet feed unit 4, mechanical interference of the process cartridge 5 with the sheet cassette 3 and with the sheet feed unit 4 can be avoided in case of attachment and detachment of the process cartridge 5 after the door 2 is opened and the sheet cassette 3 is removed from the frame 2 as shown in FIG. 3. In the latter case, a degree of freedom as to attachment/detachment path of the process cartridge 5 can be enhanced, and therefore, a degree of freedom as to the location of the LED array 57 can be enhanced, and a compact device can result.

A laser printer according to a second embodiment of the invention will next be described with reference to FIG. 4 wherein like parts and components are designated by the same reference numerals as those shown in FIGS. 1 through 3. The second embodiment also provides the structure having bosses 5B, rotation shaft 53A and guide groove 71 similar to the first embodiment. However, the second embodiment allows a process cartridge 105 to be detached from an attached to a frame 102 without removing a sheet cassette 103 from the frame 102. To this effect, a sheet supply roller 143 is pivotally movably supported to a sheet feed unit 104, and the sheet cassette 103 is not provided with the pressure plate 31 and the separation pad 32. Instead, an inclined wall portion 103A is provided for abutment with a leading edge of the sheet P.

In the second embodiment, the sheet supply roller 143 is rotatably supported to one end portion of a lever 142, and another end portion of the lever 142 is pivotally movably supported to a pivot shaft 141 provided in the sheet feed unit 104. The lever 142 is pivotally movable between a sheet supply position in which the sheet supply roller 143 is in pressure contact with an uppermost sheet P in the sheet cassette 103 and a retracting position in which the lever 142 is retracted into a space in the sheet feed unit 104. A biasing spring (not shown) is connected to the lever 142 for biasing the lever 142 in a clockwise direction in FIG. 4, i.e., to the retracting position.

Figure 4:
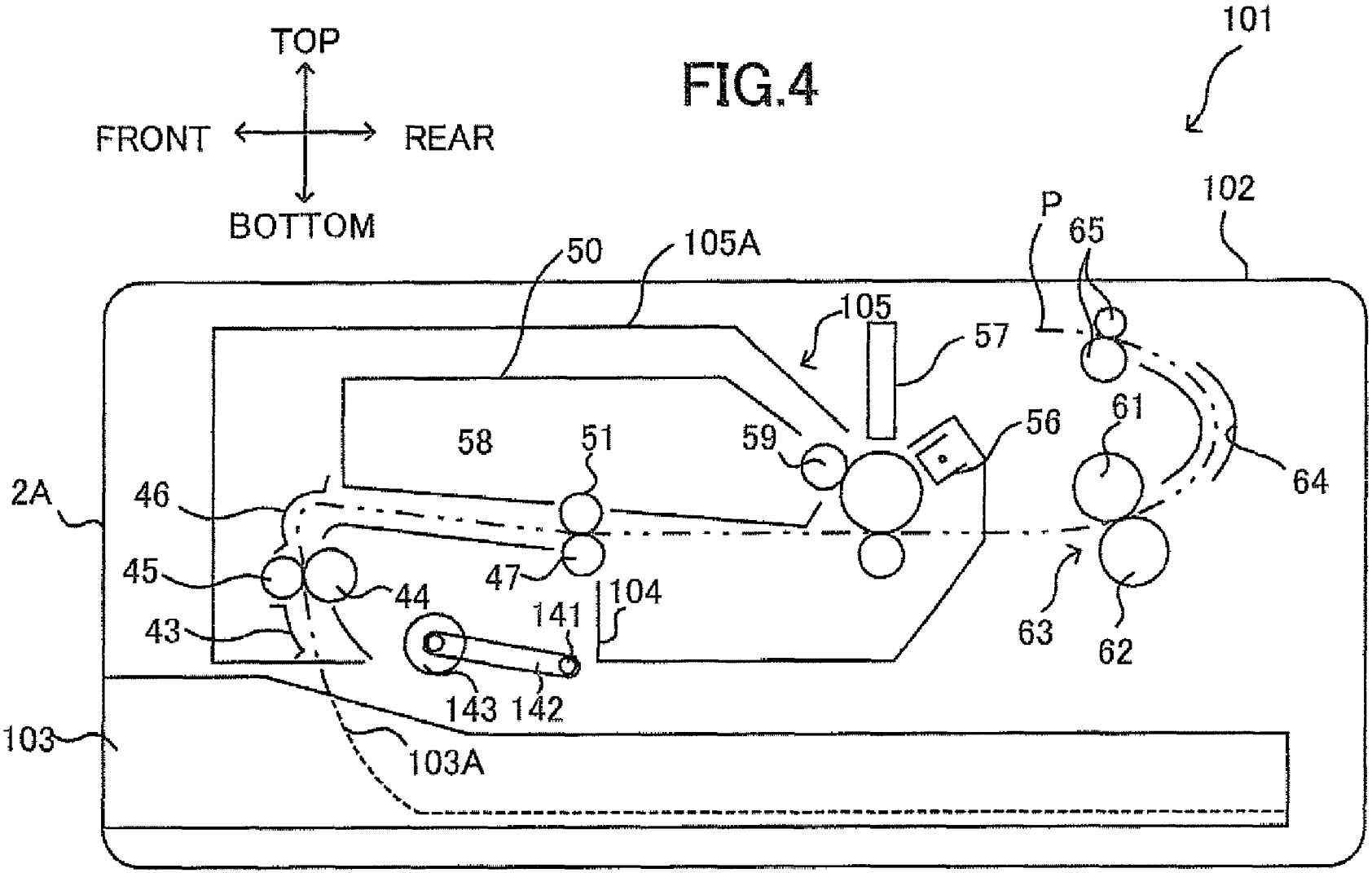
FIG. 4 is a schematic vertical cross-sectional view of an image forming device according to a second embodiment of the present invention.

A conventional planetary gear mechanism (oscillating gear mechanism) is provided for transmitting rotation of the motor (not shown) to rotate the sheet supply roller 143 in a clockwise direction in FIG. 4 and for pivotally moving the lever 142 in a counterclockwise direction in FIG. 4. Upon rotation of the motor, the lever 142 is pivotally moved in the counterclockwise direction against the biasing force of the spring (not shown), so that the sheet supply roller 143 is brought into contact with the uppermost sheet P, and the uppermost sheet P will be fed frontward by the clockwise rotation of the sheet supply roller 143. Thus, the leading edge of the sheet P abuts against the inclined wall portion 103A, and the sheet P is nipped between the sheet supply roller 143 and the inclined wall portion 103A, and is gradually flexed. Consequently, the uppermost sheet P can be separated from the remaining sheet stack and can be further fed frontward. Upon shutting-off the driving force from the motor, the lever 142 and the sheet supply roller 143 are retracted into the sheet feed unit 104 by the biasing force of the spring. Incidentally, details of the sheet supply roller 143 and the cassette 103 is described in Japanese Patent Application Publication No. 2005-247539.

Since the sheet supply roller 143 is retracted into the sheet feed unit 104, the sheet feed unit 104 can reduce its height at its non-operational phase. Therefore, attachment and detachment of the process cartridge 105 can be facilitated without removal of the sheet cassette 103, and a compact device can be realized. Incidentally, the laser printer can further be downsized if the process cartridge can be attached to and detached from the frame 2 after removal of the sheet cassette 103 as long as the above-described pivotable sheet supply roller 143 is employed.

Various modifications may be conceivable. For example, in the foregoing embodiments, the sheet feed unit 4, 104 is fixed to the process cartridge case. However, the sheet feed unit can be detachably attached thereto. Further, the sheet guide 43 can be provided at the cassette 3, 103 instead of the sheet feed unit 4, 104. Further, in the above-described embodiments, the process cartridge 5, 105 is pivotally moved about the bosses 5B when the rotation shaft 53A is moved along the slanting guide groove 71A because of the configuration of the guide groove 71 including a horizontal portion and the slanting portion. However, a guide groove that allows the process cartridge 5, 105 to move without changing its posture is also available. Still however, the above-described guide groove 71 is advantageous in that the photosensitive drum 53 can be moved upward with a lesser force.

While the invention has been described in detail with reference to the embodiments thereof, it would be apparent to those skilled in the art that various changes and modifications may be made therein without departing from the spirit and scope of the invention.

What is claimed is:

1. An image forming device comprising:

a frame having a front opening provided with a door;

a sheet cassette configured to be attached to and detached from the frame for accommodating a stack of sheets;

a process cartridge detachably assembled in the frame and accessible through the front opening upon opening the door, the process cartridge being movable to an operating position in the frame for image formation, the process cartridge comprising:

a casing movably supported by the frame;

a photosensitive drum disposed in the casing and having an outer surface in which an electrostatic latent image is formable;

a charger disposed in the casing for uniformly charging the photosensitive drum;

a developing roller disposed in the casing for supplying charged developer agent to the photosensitive drum; and a sheet feed unit attached to the casing for feeding each sheet on the sheet cassette toward the photosensitive drum;

an LED array supported to the frame and provided independent of the casing for forming an electrostatic latent image on the photosensitive drum after the photosensitive drum is charged by the charger, the process cartridge and the sheet feed unit being positioned between the LED array and the sheet cassette at the operating position, and the photosensitive drum being positioned close to the LED array at the operating position; and a guide structure provided at the frame to guide movement of the process cartridge along with the sheet feed unit from the operating position toward the door and away from the LED array.

2. The image forming device as claimed in claim 1, wherein the casing is divided into a main section in which the photosensitive drum is disposed, and a subordinate section in which the developing roller is disposed and developer agent is accommodated, the subordinate section being detachably attached to the main section.

3. The image forming device as claimed in claim 1, wherein the photosensitive drum has a rotation shaft having axial end portions; and wherein the frame has pair of guide walls, and each guide wall is formed with a guide groove extending substantially horizontal direction, each axial end portion being slidably engaged with each guide groove, the pair of guide grooves constituting the guide structure.

4. The image forming device as claimed in claim 3, wherein the casing is provided with a pair of bosses protruding in a direction parallel to the rotation shaft, each boss being slidably engageable with each guide groove.

5. The image forming device as claimed in claim 4, wherein the guide groove has a horizontal portion and a slanting portion slanting upward and rearward of the horizontal portion, the rotation shaft being at a rearmost end of the slanting portion and the boss being at the horizontal portion when the process cartridge is at the operating position.

6. The image forming device as claimed in claim 1, wherein the process cartridge, the sheet feed unit and the sheet cassette provide a geometrical relationship that allows the process cartridge to move along the guide structure as long as the sheet cassette is detached from the frame.

7. The image forming device as claimed in claim 1, wherein the sheet feed unit comprises a sheet supply roller configured to contact an uppermost sheet on the sheet stack on the sheet cassette.

8. The image forming device as claimed in claim 7, wherein the sheet feed unit defines therein an internal space; and wherein the sheet supply roller is movable between a contact position in contact with the uppermost sheet and a retract position in the internal space.

9. The image forming device as claimed in claim 8, wherein the sheet cassette has a slant wall portion, the uppermost sheet has a leading edge abuttable against the slant wall portion by rotating the sheet supply roller at its contact position to separate the uppermost sheet from a remaining sheet stack and to direct the uppermost sheet toward the process cartridge.

10. The image forming device as claimed in claim 1, wherein the sheet feed unit is detachable from the casing.

11. The image forming device as claimed in claim 1, wherein the sheet feed unit is fixed to the casing.

12. The image forming device as claimed in claim 1, further comprising a cleaner and a transfer roller disposed in the casing at positions directly confronting the photosensitive drum.

* * * * *